US006155748A

United States Patent [19]

Allen et al.

[11] Patent Number: 6,155,748

[45] Date of Patent: Dec. 5, 2000

[54] DEEP WATER RISER FLOTATION APPARATUS

[75] Inventors: Forrest J. Allen, Magnolia; Robert E. Bush, Houston, both of Tex.; Guy L. Gettle, Alamo, Calif.

[73] Assignee: Riser Systems Technologies, Houston, Tex.

[21] Appl. No.: 09/266,288

[22] Filed: Mar. 11, 1999

[51] Int. Cl.[7] ..... E02B 11/38; E21B 7/12

[52] U.S. Cl. ..... 405/195.1; 114/230.13; 166/350; 166/359; 175/7; 405/224; 405/223.1

[58] Field of Search ..... 166/367, 359, 166/350, 338; 405/195.1, 205, 206, 224, 224.1–224.4, 223.1; 114/230.1, 230.13, 264, 265; 441/133, 5, 3, 1; 175/5–7

[56] References Cited

U.S. PATENT DOCUMENTS

| | | | |
|---|---|---|---|
| 3,330,340 | 7/1967 | Hayes et al. | 166/350 X |
| 3,729,756 | 5/1973 | Cook et al. | 166/350 X |
| 3,858,401 | 1/1975 | Watkins | 405/224.2 |
| 4,176,986 | 12/1979 | Taft et al. | 405/195.1 X |
| 4,422,801 | 12/1983 | Tale et al. | 405/195.1 |
| 4,470,722 | 9/1984 | Gregory | 166/350 X |
| 4,477,207 | 10/1984 | Johnson | 166/359 X |
| 4,646,840 | 3/1987 | Bartholomew et al. | 166/367 X |
| 4,762,180 | 8/1988 | Wybro et al. | 166/350 |
| 5,330,294 | 7/1994 | Guesnon | 405/223.1 X |
| 6,004,074 | 12/1999 | Shanks | 405/224.2 X |

*Primary Examiner*—Dennis L. Taylor
*Attorney, Agent, or Firm*—Howrey Simon Arnold & White, LLP

[57] ABSTRACT

A dual phase riser flotation system contains a number of passive phase buoyancy modules of syntactic foam contained within an outer skin, and a number of active phase buoyancy modules which are similar to air canisters in that they may be inflated or deflated as required to provide levels of buoyancy. The passive phase buoyancy modules may contain tubes filled with air, a compressed gas such as nitrogen, or evacuated to provide additional buoyancy. Charge and discharge valves connect gas flow lines to a manifold system serving the active phase buoyancy modules.

27 Claims, 10 Drawing Sheets

DEEP WATER RISER FLOTATION APPARATUS

BACKGROUND OF THE INVENTION

The invention relates generally to risers that connect offshore drilling vessels or tension leg platforms (TLPs) to blowout preventer stacks (BOPs) or production modules in deep water. More specifically, the invention relates to flotation assemblies which may be attached to the risers to counteract or offset a portion of the weight of the submerged riser pipe, maintain the riser in tension, and/or maintain the riser in a vertical position.

Risers systems are often attached to seabed systems on the ocean floor. The water depths at which the riser system is installed may be in deep water (in excess of 5,000 feet), and, currently, the trend in the industry is toward the development of drill sites in even deeper water including depths of 10,000 ft. and beyond. The riser system which must span this depth is made up of a series of structural riser pipe sections called "riser joints," generally 50 feet in length, having mechanical connections at both ends. The riser system may also include an upper riser assembly and a lower riser assembly. To prevent the riser from buckling and to compensate for the weight of the riser system it is kept in tension by the platform or vessel, or provided with buoyancy devices, often in the form of modules or shaped elements that attach to a riser.

There are several types of buoyancy modules that have been used in the industry. One particular type of buoyancy material in use in the marine drilling industry is syntactic foam, which has found extensive marine uses in applications requiring a buoyancy material capable of withstanding relatively high hydrostatic pressures. The compartmentalized structure of syntactic foam tends to localize failure as compared to single wall pressure vessels which fail catastrophically. In general, syntactic foam consists of hollow glass microspheres and epoxy binder or a high strength plastic matrix. It is especially suitable for marine applications because of its high strength and low density, allowing the foam to provide buoyancy while withstanding pressure from deep water.

In the past, semi-annular syntactic foam flotation modules have been clamped to the riser, or strapped together around the diameter of the riser joints. This type of system is "passive flotation," that is, the buoyancy of the syntactic foam modules cannot be adjusted after installation.

Syntactic foam, or similar buoyancy foams, may be manufactured in a variety of densities as required by the water depth. The trend toward even greater drilling and production capability with respect to the ultimate depth of the water at the drill-site affects the density requirement of the buoyant materials used to provide passive flotation, for example, syntactic foam modules. As the water depth increases, the buoyancy required per length of riser joint increases accordingly. This results in increased diameter and weight of individual flotation modules.

The increase in the size of these modules reduces or eliminates the ability to construct a buoyant riser for use below 12,000 feet that will run in through a standard 48" rotary table on offshore drilling vessels or on TLP drilling rigs. Because this is an industry standard size, it would, in most cases, be impossible, or at least impractical, to reconfigure a drilling vessel to accommodate a larger diameter rotary table. Moreover, the increased weight of a large diameter buoyant module results in difficulties in both handling and storage. As such, the current system of passive flotation using syntactic foam modules, with the drilling equipment in use today, may be incapable of providing the buoyancy needed to keep risers in tension at greater depths.

Another type of buoyancy system that has been used for underwater risers is an open-ended air can (canister) system. Typically, in this type of system a plurality of cans having an open bottom are attached to the riser. The cans are disposed with their bottoms open toward the seabed. A compressed air (or other gas) conduit from the surface fills the bottom-most can, displacing the water in the can. Another conduit allows the compressed air to flow into the immediately-above adjacent can, and a valve may be employed to ensure that the second and later cans are air-filled only after the air in the first can reaches a desired level of water displacement. This proceeds until all the cans are filled with air, or the desired buoyancy affect is achieved. This type of can system is an "active flotation system," in that the supply of air, and the corresponding net buoyant effect, can be controlled.

The canister system may alternatively derive buoyancy by displacement of water from the annulus between the OD of the riser casing and the ID of an outer housing (the canister) with compressed air or gas. A shut-off valve within the canister annulus controls the height of the gas/liquid level above the open end of the outer canister housing, thus trapping the gas in the canister.

As with the syntactic foam modules, air can systems must provide progressively greater buoyancy along the axis of the riser as the water depth and weight of the riser above increase; as such, progressively larger volume cans are required. At greater depths, the differential pressure between the sea-water outside the can and the compressed air inside the can is larger. The air cans may be fabricated from a number of materials (usually steel casing), most of which add to the weight and stiffness of the riser joints and may contribute additional stresses to the couplings. Moreover, the increased weight associated with the thicker walls needed at greater depths offsets a portion of the total buoyant force of the can system.

Another problem associated with current riser systems is an inability to quickly disconnect the riser from the vessel or platform when storms require the vessel or platform to move to safety; the remaining riser sections must survive the storm without losing all or part of the flotation system, while still being kept in tension and vertical.

A semi-submersible, drill ship, or TLP operating in the Gulf of Mexico or other deep water locations in the world will usually employ a "guidelineless" re-entry system because of the extreme water depth (8,000 ft. to 12,000 ft) as shown in FIG. 1. Vessels equipped with dynamically positioned automatic station keeping systems employ no mooring lines and are subject to the need to move off location during significant storms and during the hurricane season. This subjects the riser string to an "emergency disconnect" and potential catastrophic failure.

At present, when a drill ship must abandon a location due to a hurricane warning, the drilling riser (made up of joints of pipe connected by riser couplings) and the drill-string that has been deployed, must be recovered to the deck of the drilling vessel. This normally involves shearing the drill string at the subsea BOP using shear rams, unlocking the "lower marine riser package" (LMRP) from the blowout preventer stack and retrieving the drill-string and riser to the rig floor (FIG. 1). The drill pipe must be stored on the drilling vessel, followed by the riser joints, or storage provided on other vessels, which may be difficult in the extreme weather attendant with an approaching storm.

Technology is available that may significantly reduce the need for storage of long strings of drill pipe and risers during emergency disconnect. For example, the method and apparatus disclosed in U.S. Pat. No. 5,676,209 provides a subsea riser system with an upper stack of blowout preventers and an air buoyancy chamber placed in the riser at about 500 ft below the ocean surface (where lateral currents are minimal). Attached buoyancy modules below the BOP stack maintain the riser between the two BOP's generally in tension and vertical. Drill pipe may now be sheared in the upper BOP, leaving only the upper joints of drill pipe to be recovered to the rig floor during the emergency. The lower string remains in the well and/or riser until after the emergency, thus, protecting the drilling fluid in the riser and the casing.

However, with this type of technology, it is important that the flotation system associated with the riser sections that remain attached to the seabed be able to maintain the riser in tension and vertical, and that it is recoverable if necessary through the rotary table if repair and/or replacement is needed after reconnecting. The flotation apparatus of the current invention would be beneficial with the riser remaining connected to the subsea well, as well as with the riser string above the uppermost BOP stack.

SUMMARY OF THE INVENTION

The embodiments of the current invention reduce the weight, additional stiffness, and stresses imposed on the riser system by the use of syntactic foam modules systems or air canister systems at deep water depths.

The current invention provides a riser flotation system that contains both active and passive modules. The passive phase buoyancy modules are constructed of syntactic foam or other suitable material surrounded by an outer skin. The modules are constructed in formed shapes, which may be semi-circular or lesser arcuate sections, which will allow installation on the outer diameter of the riser joints or other riser segments.

The passive phase buoyancy module may also contain a series of tubes which may be interconnected and evacuated or filled with a compressed gas such as nitrogen to provide additional buoyancy.

The adjustable phase buoyancy module is intended to provide additional buoyancy which may be required at greater water depths, or under the upper BOP stack in emergency disconnect systems. The adjustable phase buoyancy module has an outer housing, which is open to seawater, and an inflatable bladder contained within the housing. A series of control valves connects the bladder and an associated manifold system to a gas charging line to inflate and deflate the bladders. In this way, the buoyancy of the active phase module is controllable.

The control valves are responsive to seawater pressure and to a predetermined closing force. Compressed gas is supplied to the active phase module through the control valve when the charge pressure in the gas line and manifold is greater than the combination of the seawater pressure plus the closing force (exerted by a spring or other resilient member). By altering the closing force, and knowing the water pressure (which is constant at a given depth), the system can be tailored to provide appropriate charging for the bladders from a dedicated compressed gas line.

A hydraulically controlled emergency dump valve is also included in the system of the current invention to facilitate reducing the pressure in the bladders of the active phase module when the riser is being recovered to the surface.

The dual phase buoyancy system of the current invention maintains a suitable external diameter (OD) for the flotation system and a 20 inch riser to permit the running of the riser and attached flotation system through a standard 48" rotary. Sufficient buoyancy is provided to that the system may be run to water depths of 10,000 feet or more. This will eliminate the need for major rig restructuring or replacement simply to accommodate an increase in the buoyancy package diameter. However, if desired by the operator, the advantages of the dual phase buoyancy system can be applied to diameters over 48".

BRIEF DESCRIPTION OF THE DRAWINGS

Other objects and advantages of the current invention will become apparent upon reading the following detailed description and upon reference to the drawings in which.

DESCRIPTION OF ILLUSTRATIVE EMBODIMENTS

1. Dual Phase Buoyancy System

Figure 1:
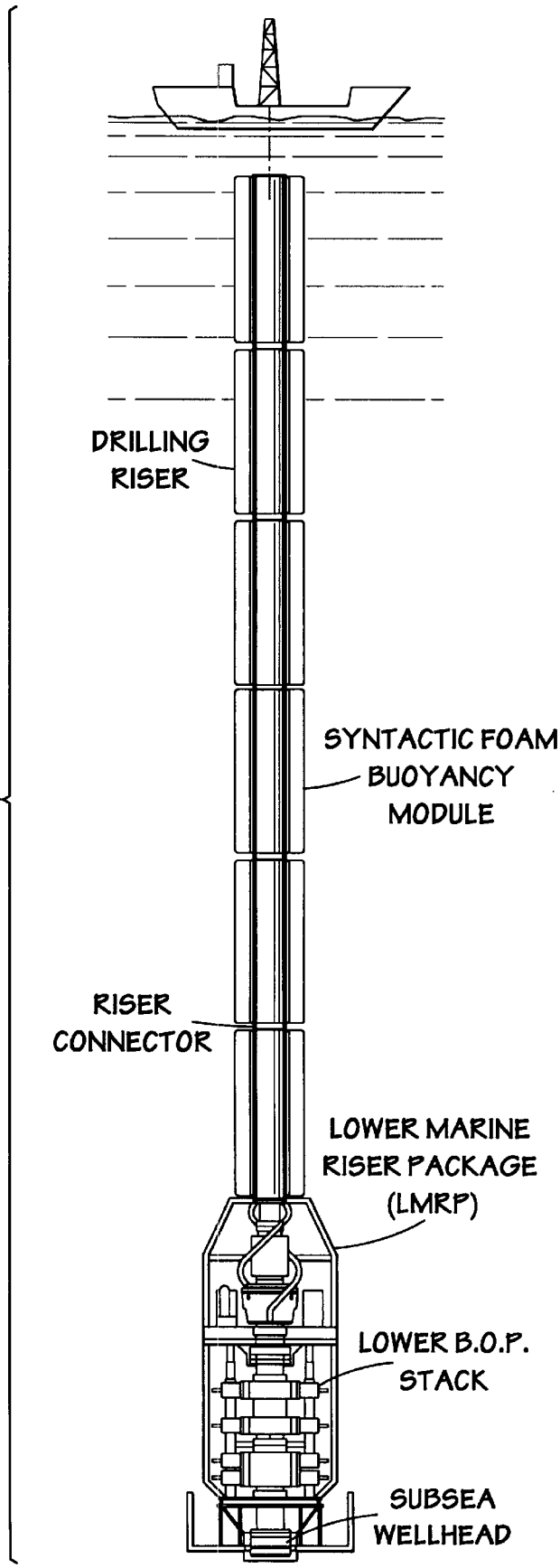
FIG. 1 (PRIOR ART)
FIG. 1 is an illustration of a subsea wellhead and riser system known in the art.
Figure 2:
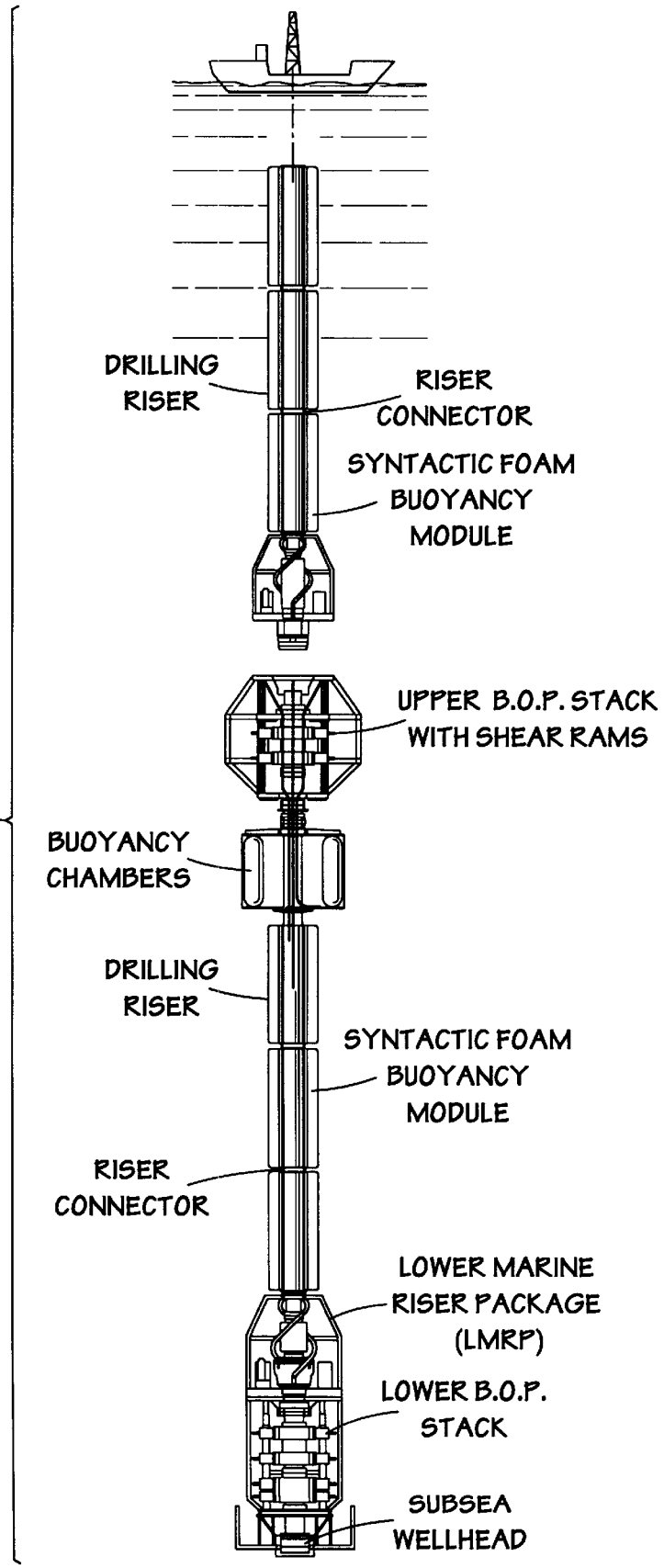
FIG. 2 (PRIOR ART)
FIG. 2 is an illustration of a riser system of the prior art in which the upper marine riser package and a portion of the drilling riser may be disconnected and the lower riser portion left in place.
Figure 3:
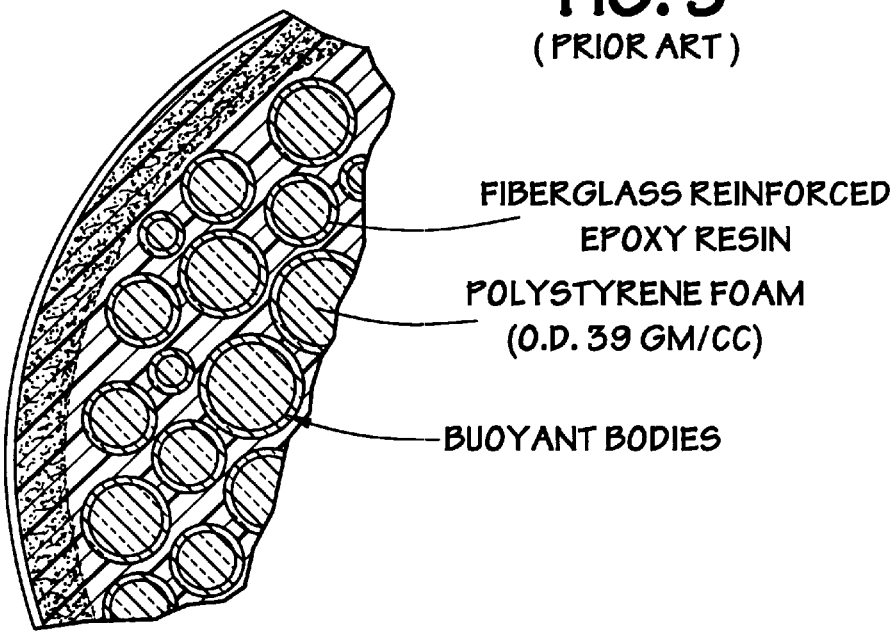
FIG. 3 (PRIOR ART)
FIG. 3 is a cross sectional view of syntactic foam which is known in the prior art.
Figure 4:
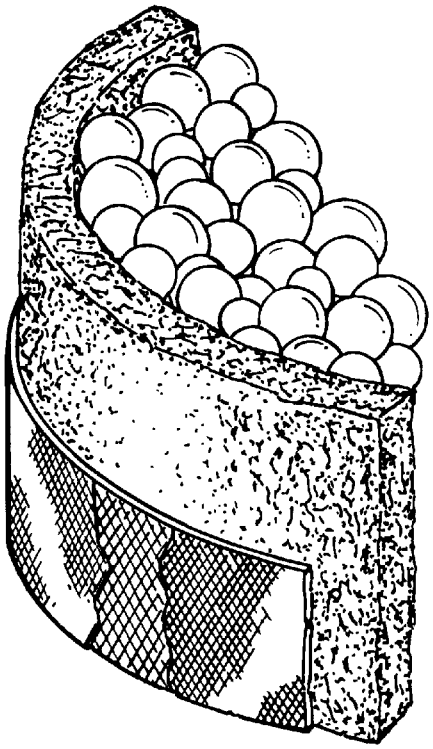
FIG. 4 (PRIOR ART)
FIG. 4 is a sectional view of the syntactic foam of FIG. 3.
Figure 5:
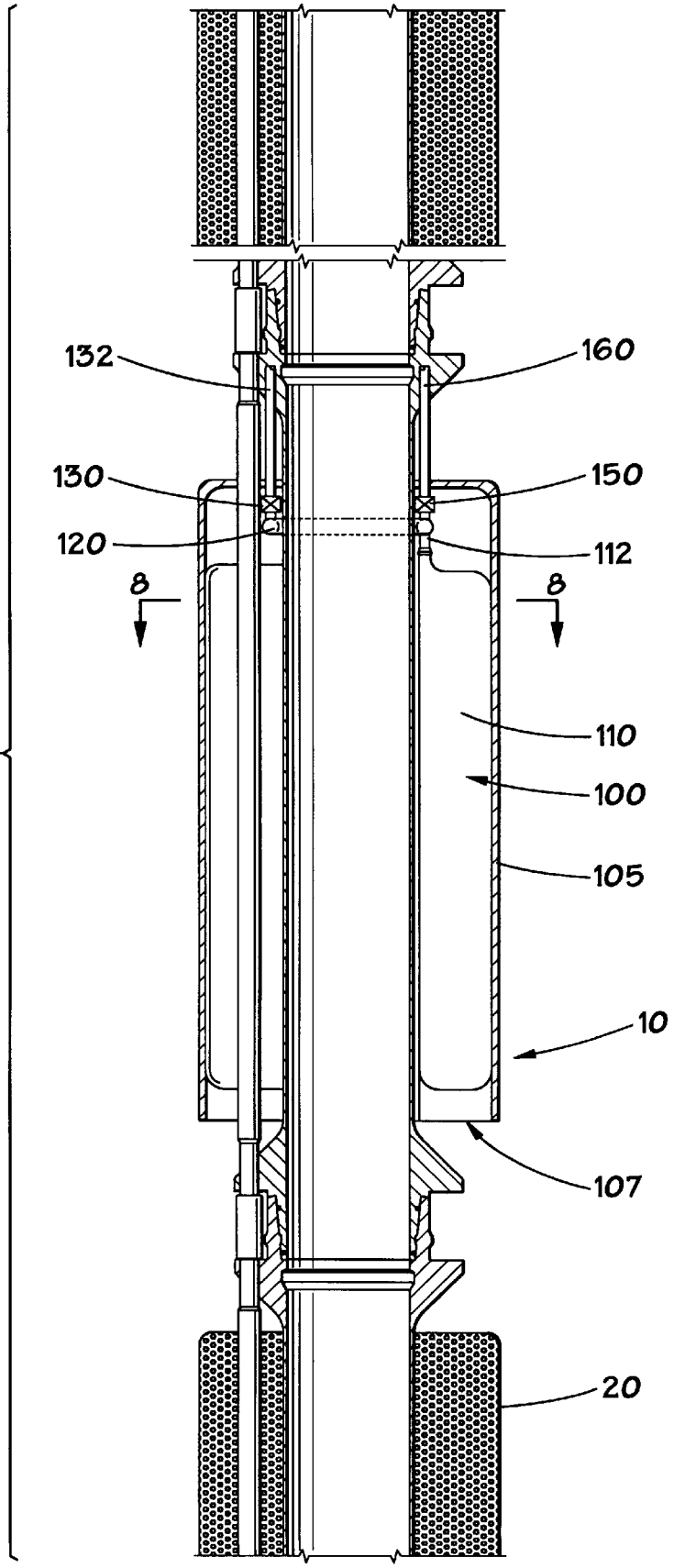
FIG. 5 is a schematic illustration of the dual phase riser flotation system of the current invention in which the active and passive phase modules alternate longitudinally.

The main elements of the dual phase buoyancy system 10 are shown schematically in FIG. 5. The functions of the passive phase buoyancy module 20 (PPBM) and the adjustable gas phase buoyancy module 100 (APBM), combine to increase system buoyancy to the extent that the diameter of the system can be maintained to approximately the 46"–47" diameter needed to lower the riser through the standard rotary openings.

The improved riser flotation apparatus of the current invention provides a refined buoyancy system for use with deep water marine drilling risers in particular on rigs requiring a maximum 48" rotary. This size has been selected for good reason, however, any larger size now in use may be selected to fit the riser requirements. Of course, if the is rig or vessel has a rotary more than 48' in diameter, the advantages of the system are equally applicable. However, because there is a need for a deep water riser flotation system for use with a standard 48" rotary, the system of the current invention can provide increased average buoyancy per foot of riser dependent upon the mix of components that are utilized. The required buoyancy for riser strings below 12,000 ft., at the clear opening limits of the rotary (generally 48") can be met if the full range of buoyancy modules are deployed, including: (1) one or more passive phase buoyancy modules 20; (2) compressed gas tubes 40 included in one or more of the phase buoyancy modules 20, and; (3) one or more adjustable phase buoyancy modules 100.

2. Passive Phase Buoyancy Modules (PPBM)

The cross sectional layout of one embodiment of a passive phase buoyancy module (FIG. 6A) is sized to run through a 48" rig opening, and is for use on a 20" riser pipe with two choke and kill lines 50, a boost line 60 and an air line 65 to serve as an example of a basic system design.

Figure 6A:
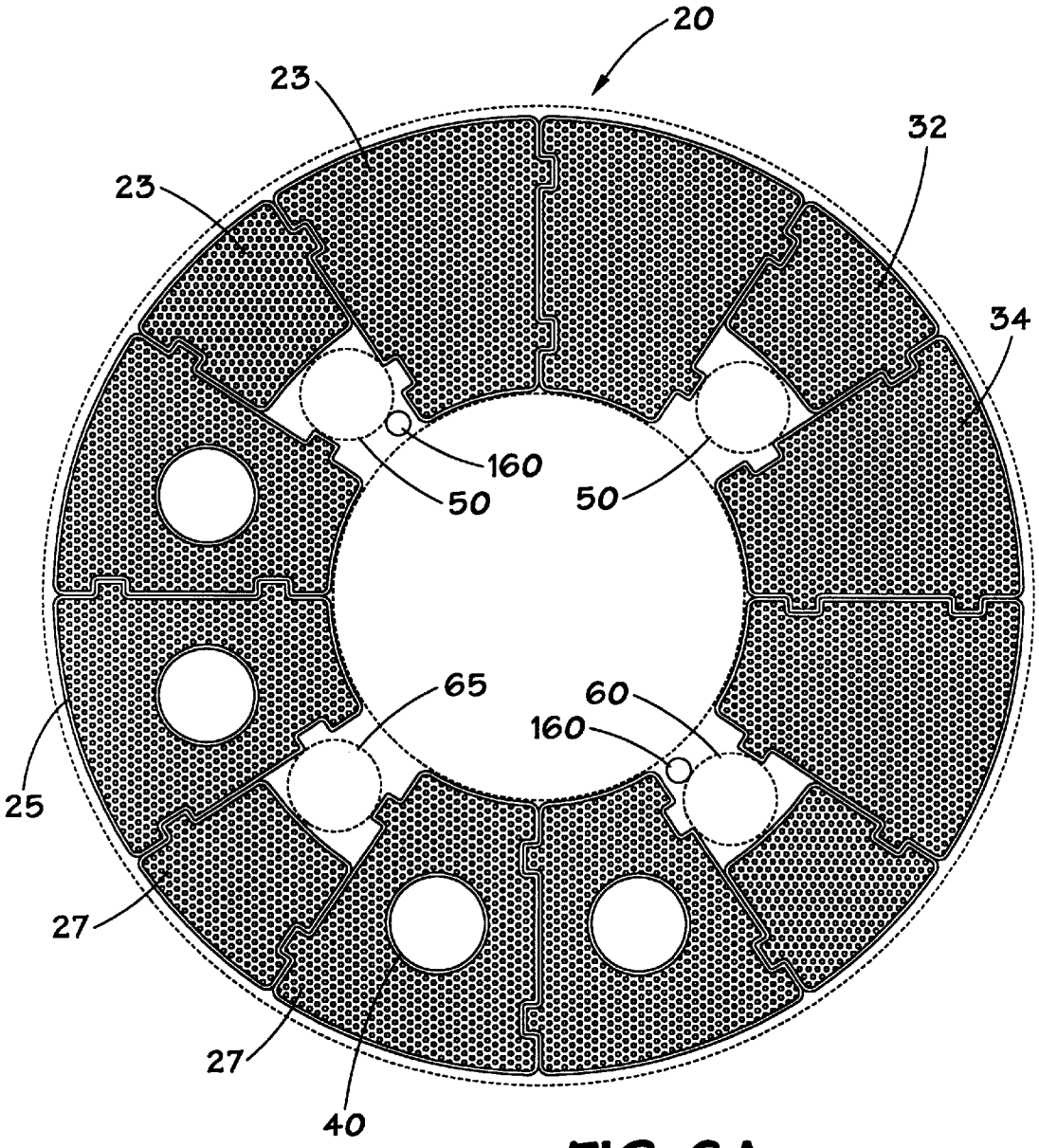
FIG. 6A is a cross section of one embodiment of the dual phase riser system of FIG. 5.
Figure 6B:
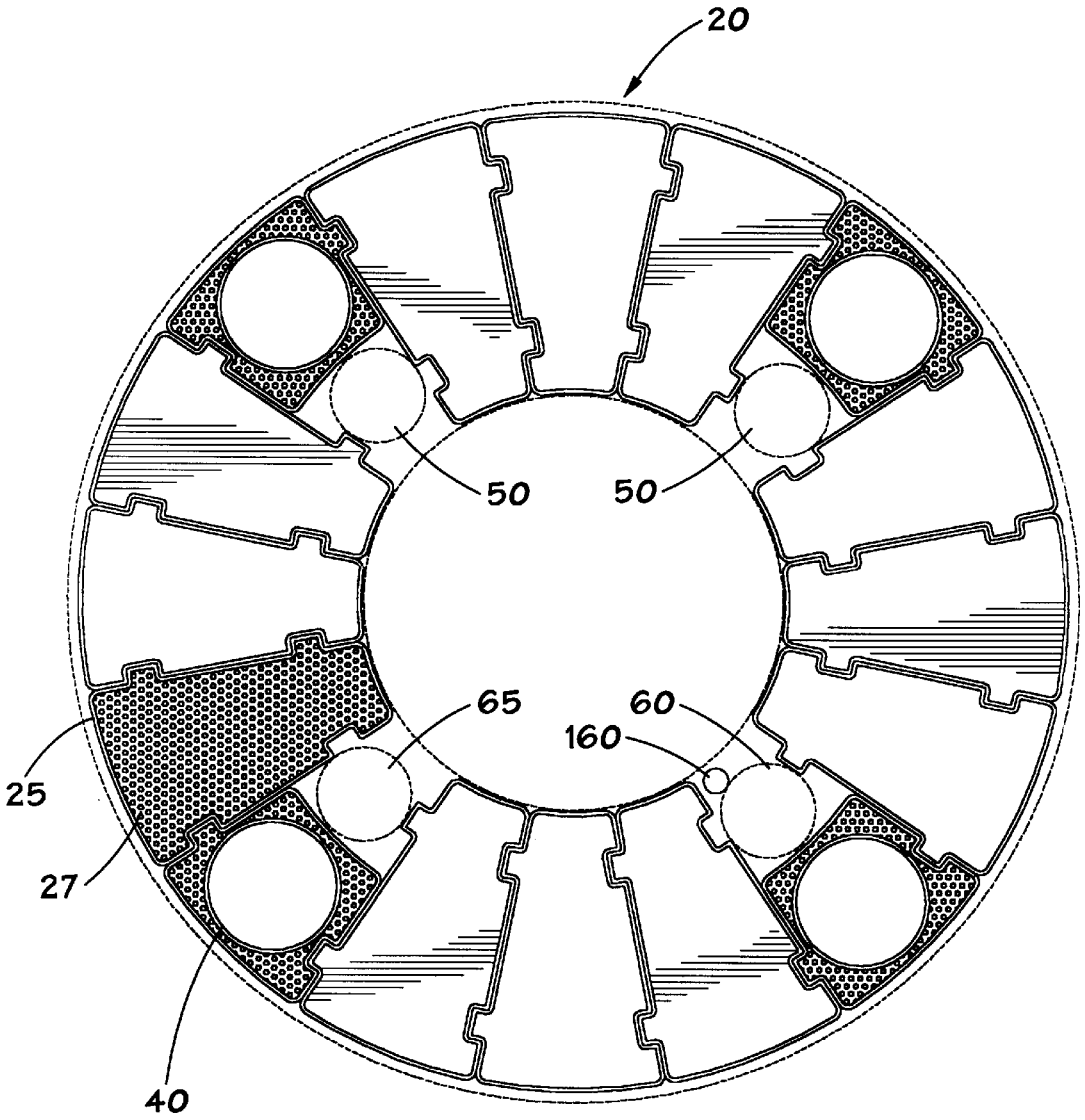
FIG. 6B is a cross section of another embodiment of the dual phase riser system of FIG. 5.

The PPBM 20 could be fabricated with two part molds, but in a preferred embodiment the manufacturing process is pultrusion with special dies to form an outer skin 26. The material used may be one of several resins, such as epoxy, polyester, phenolic, or other suitable resins mixed with fiberglass for strength. The interior component of the PPBM 20 is preferably syntactic foam 27 comprised of hardenable resin containing buoyant microspheres. The syntactic foam 27 may be injected into the cavities formed through the pultrusion process, prior to infra-red heating of the pultruded product. If other processes are employed to form the skin 25, the syntactic foam 27 or other interior component may be combined through other methods. Two embodiments of design/construction forms of the PPBM 20 are shown in FIGS. 6A and 6B. In one embodiment, the module segments 23 are formed or pultruded in interlocking shapes having the outer protective skin 25 of epoxy or other material formed in a die designed to permit injection of syntactic foam or other buoyant material into the interior cavity, to provide a mostly homogeneous bonding of the materials while the infrared heating and/or other forms of radio-frequency heating units provide the necessary temperature.

The outer skin 25 can be formed from a wide variety of different types of buoyant bodies and hardenable resins which are well known in the art. The hardenable resin may comprise epoxy, polyester, urethane, phenolic, or the like, and will be mixed with a multiplicity of size graded microspheres to reduce density. Also, a hot melt resin or wax could be used, flowable when hot but hard when cooled. One example of an outer skin 25 that can be used with the current invention is disclosed in U.S. Pat. No. 4,021,589 which is incorporated herein by reference.

The buoyancy that may be obtained by the use of readily available mixtures of materials used to form syntactic foam is well known within the industry. U.S. Pat. No. 3,622,437 provides one example of a syntactic foam-type buoyancy material, and a method of manufacturing the same, and is incorporated herein by reference. Other examples of suitable syntactic foams are well known in the art and may be used with the current invention.

The passive phase buoyancy module 20 fabricated by the pultrusion process may have the epoxy or other suitable resins mixed with fiberglass for strength as the skin (housing) filled with syntactic foam by an internal mandrel upstream of the bonding heat source, infrared or other forms of radio-frequency heating units, selected to assure homogeneous bonding of component materials.

The embodiment illustrated in FIG. 6A, includes a plurality of a minor arcuate segments 32 (approximately 22.5°) for use over choke and kill lines 50, and standard arcuate segments 34 (approximately 33.75°). In this embodiment a passive phase buoyancy module 20 is comprised of four minor segments 32 and eight standard segments 34, all injected with syntactic foam 27 to provide mold strength and buoyancy to the module. In another embodiment illustrated in FIG. 6B, the passive phase buoyancy module 20 is comprised of four minor segments 33 and twelve standard segments 35. Other embodiments are envisioned wherein the number of minor and standard segment is more or less than in the embodiments shown. It is preferable that the segments 23 include interlocking portions, whatever arcuate length is chosen.

The need to achieve an improved buoyancy within a restricted diameter is imposed by the desire to utilize the existing deep-water drilling rig fleet without requiring rotary table enlargement, at a cost which could prevent the drilling of many deep-water prospects. When essential to increase the buoyant lift of passive phase buoyancy systems, tubes 40, which may be nitrogen filled, may be installed in a multiplicity of the segments, to boost the net buoyancy of the PPBM 20. The tubes 40 may be constructed of suitable resins and may be sealed internally to prevent permeation of low molecular weight gases through the tube wall. Tubes 40 may alternately be made of lightweight high strength non-corrosive metal or other substantially impermeable material. The functional role of this component is entirely static, therefore, tubes 40 may be pumped to a vacuum and sealed, or subjected to a vacuum and then filled with a compressed gas, such as nitrogen, at low pressure (100–500 psig). In one embodiment, tubes 40 are filled with nitrogen.

The standard segment is capable of receiving a tube 40 to improve upon the net buoyancy of the complete assembly. In one embodiment, tube 40 has an outside diameter of 5–6 inches. Tubes 40 may be inserted in the mandrels of all the standard segments in order to maximize the PPBM buoyancy.

Figure 7B:
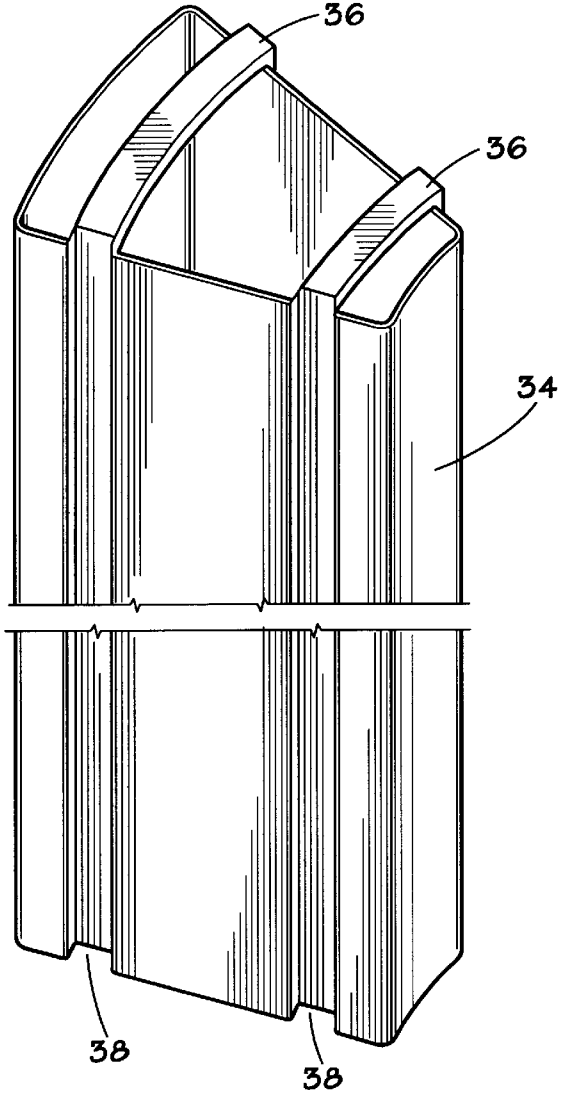
FIG. 7 is an illustration of two embodiments of the passive phase buoyancy modules.
Figure 7A:
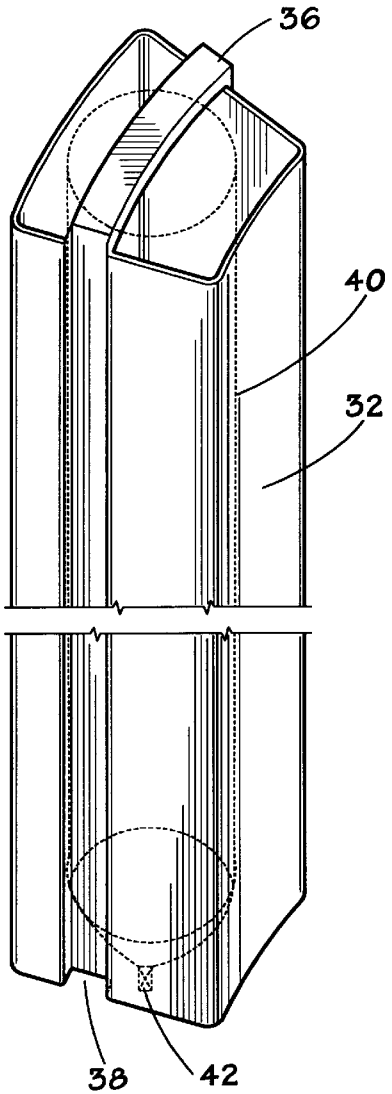

In FIG. 7, the buoyancy tube 40 is shown in a PPBM segment with a threaded shut off valve or other connector 42 that provides the means of attaching a vacuum pump or gas input line by which the tube 40 is charged and sealed with the selected compressed gas or vacuum. However, in an embodiment in which tubes 40 are manufactured using plastic, the tubes may be filled with air at surface pressure and sealed, eliminating connector 42. Since, it is the purpose of tube 40 (filled with low molecular weight gas) to increase the buoyancy of the combined assembly of passive phase buoyancy modules 20, it can be beneficial to place buoyancy tubes 40 in the standard segments, 34 or 35, of FIGS. 6A and 6B.

Properly sized buoyancy tubes 40 may be installed in each of the three sizes of passive phase buoyancy modules 20 as disclosed in FIGS. 6A and 6B, or in any other module segment, when it is necessary to increase buoyancy by the use of low molecular weight gas. The tubes 40 are supported by syntactic foam 27 as shown in FIGS. 6A and 6B, and charged through the connector 42 of FIG. 7. Buoyancy tubes 40 are intended to be permanently installed and are not subject to adjustment.

3. Adjustable Phase Buoyancy Module (APBM)

If additional system buoyancy is necessary it can be supplied by the inclusion of one or more adjustable phase buoyancy modules 100 in the system. The adjustable phase buoyancy modules 100 of the current invention are intended to be used to provide the additional buoyancy needed for maximum water depth risers, while still maintaining an approximately 46" diameter. The adjustable gas phase buoyancy modules (APBMs) 100 should generally, although not necessarily, be employed in the upper portion of the riser, where additional buoyancy becomes a matter of considerable concern since the passive phase buoyancy modules 20 provide the means of graded flotation, using either syntactic foam or a combination of foam and gas filled tubes, throughout the riser.

Figure 8:
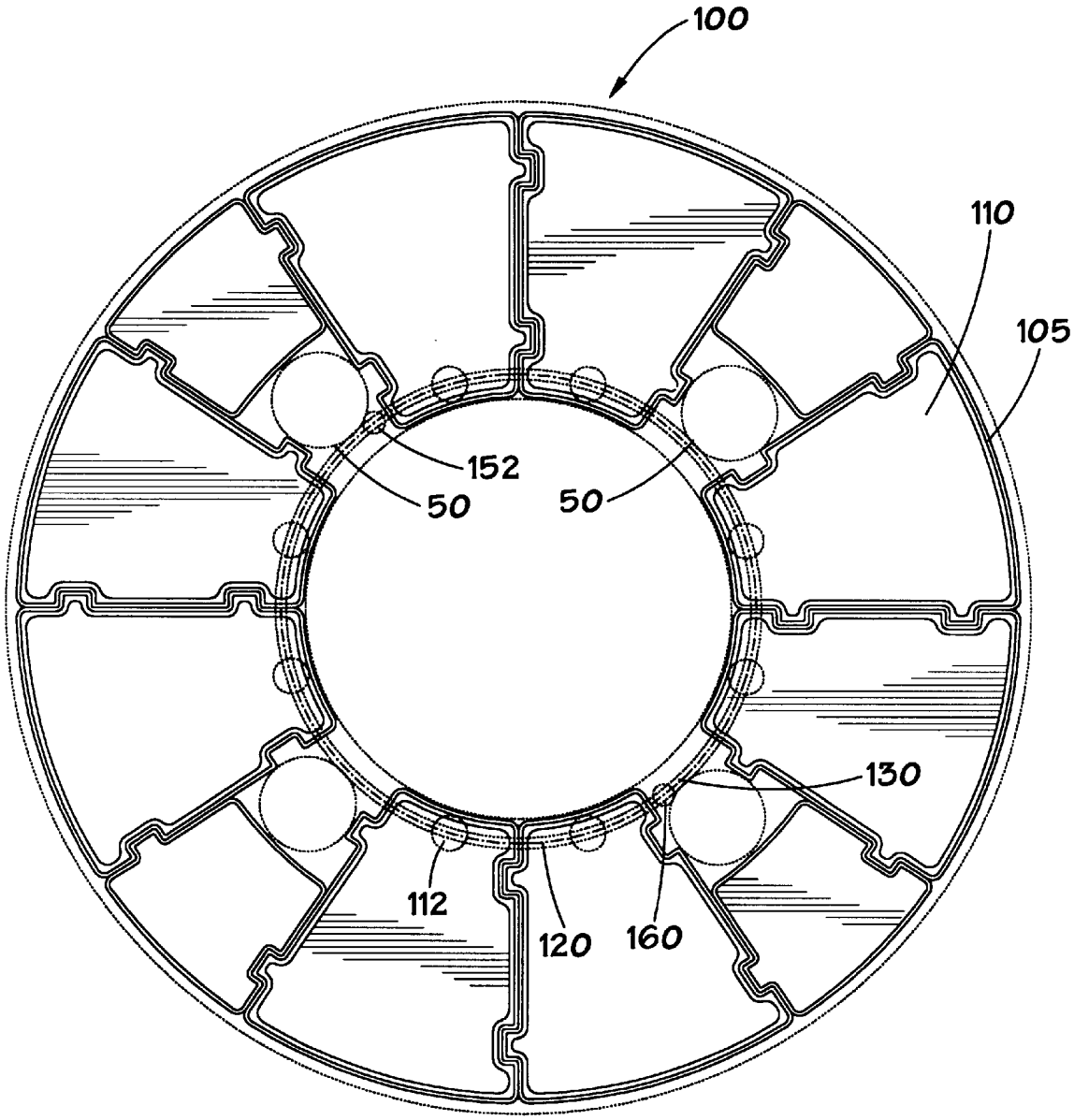
FIG. 8 is a cross section of the active phase buoyancy module.

Referring to FIG. 8, the outer housing 105 of the adjustable gas phase module 100 may be made in a two part mold, or, as is preferred, by the pultrusion process. The outer housing 105 of this assembly houses and protects the internal pressure containing bladders 110. Typically, eight pressure containing bladders corresponding to eight APBM sections are envisioned, although this is subject to design considerations.

The housing 105 can be made of a fiberglass filed resin or a carbon fiber filled resign, wherein the resin is epoxy or polyester. Bladders 110 may be made of Kevlar or similar material that is capable of withstanding long term exposure to seawater and nitrogen gas. It should be noted that the outer housing 105 of the APBM 100 may be made by the same die and tooling as the two segment configuration (minor and standard) of the PPBM 20, discussed above.

Figure 9:
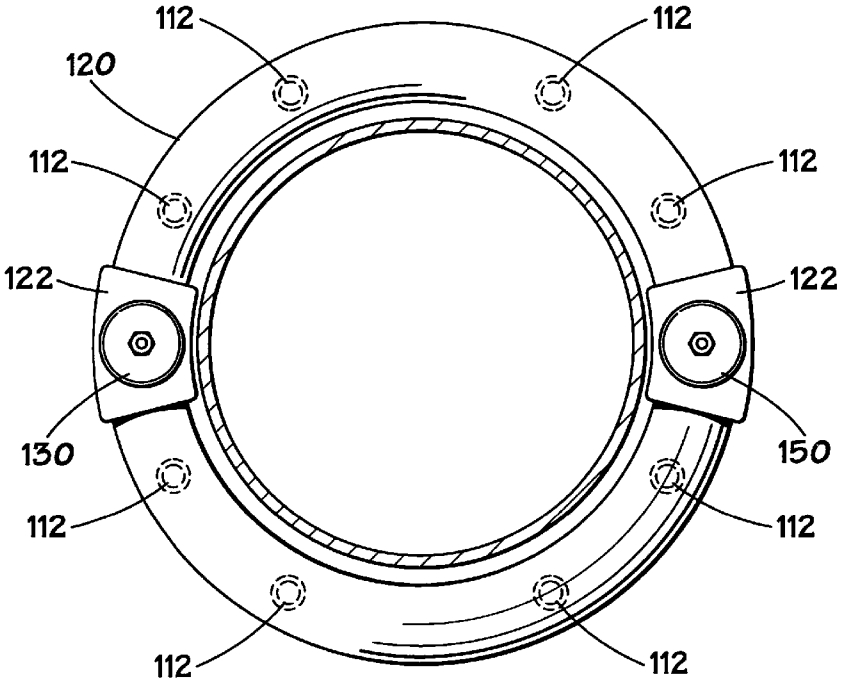
FIG. 9 is a cross section of the active phase buoyancy module showing the charging and discharging manifold.

In one embodiment, collapsible liners are installed in each of the segments as pressure containing bladders 110 having nipples 112 and shutoff valves for attachment to the charging and discharging manifold 120, as shown in FIGS. 5 and 8 and then in more detail in FIG. 9. Referring again to FIG. 5, an overall view of the relative positions of the components the inflatable bladders 110 are shown in their protective housings 105, which are open to seawater pressure at the lower end 107. Each of the bladders 110 are terminated at the charging and discharging manifold 120 which inflates all bladders 110 through charge valve 130.

Figure 10:
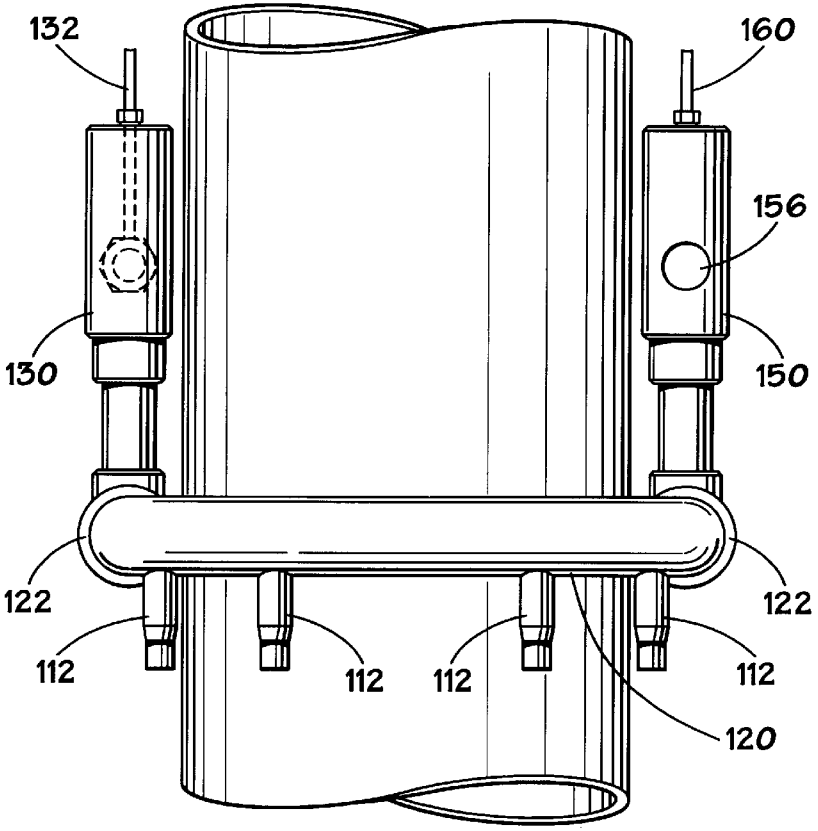
FIG. 10 illustrates a section of the charging and discharging manifold in elevation form.

The arrangement of components in the APBM 100 is more fully described by FIG. 9 which shows a top (cross sectional) view at the manifold 120 and FIG. 10 which shows a schematic drawing of the manifold 120 mounted around the riser casing. The sequence of inflation and subsequent deflation of the bladders 110 comprising the flotation means of the adjustable phase buoyancy module 100 is controlled through the manifold 120. In one embodiment, the manifold 120 consists of 3½" tubing joined by clamp connectors 122 at each hemisphere, the housing of which provides connections for the charge valve 130 (shown more completely in FIG. 11) and the emergency dump valve 150 (shown more completely in FIG. 12). Additional ports and connections are provided on both the control valves 130 and 150. Both of the control valves thread or otherwise connect and seal into the clamp couplings 122. In one embodiment, threaded nipples for attachment of eight inflatable bladders 110 extend from the manifold 120.

Figure 11:
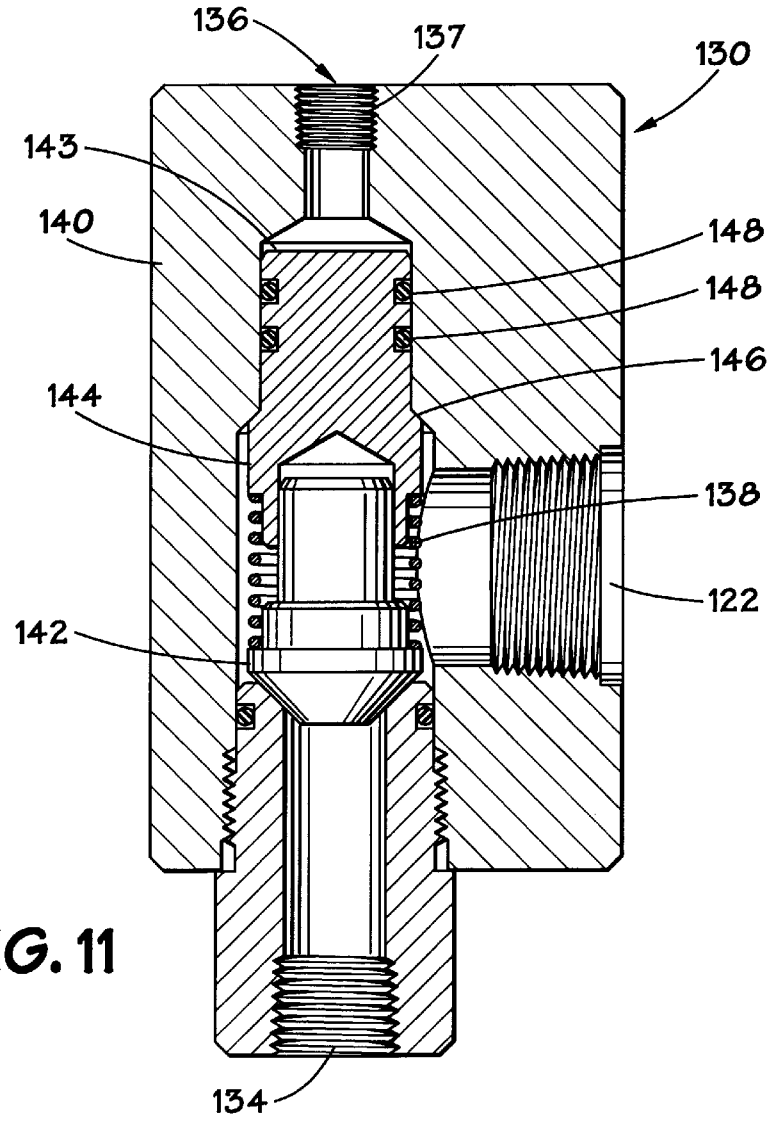
FIG. 11 is a sectional illustration of an embodiment of a charging valve of the current invention.

The charge valve 130, as shown in FIGS. 10 and 11, is attached to the manifold connector 122 and has a port connection 134, preferably threaded, for piping from the gas line 132, which in a preferred embodiment is a nitrogen line. Gas line 132 may be used to charge the bladders 110, attached to each of the bladder nipples 112, with compressed gas.

Referring again to FIG. 5, an adjustable phase buoyancy module 100 is illustrated in section. Two of the preferred eight flexible bladders 110 are housed in pultruded housing segments 105 that protect the buoyancy bladders 110 from damage yet permit the exterior of the bladders 110 to be exposed to seawater pressure through the open lower end 107. The manifold 120 supports the threaded nipples or other junction connectors 112 to which the bladders 110 are attached, as well as the control valves, charge valve 130 and the discharge valve 150, compressed gas or nitrogen line 132, and hydraulic line 160. FIG. 8 is a cross sectional view of a complete APBM 100 at the level of the manifold 120, and shows eight fully inflated pressure bladders 110 in the segment housings 105.

The charge valve 130 controls the input of compressed gas (such as nitrogen) into the inflatable bladders 110 of the APBM 100. Nitrogen supplied through the gas flow conduit 132 must open the valve seat against the force of seawater pressure and the valve bias setting. In one embodiment the valve bias is provided by a valve spring 138, although other biasing members known in the art could be used. More particularly, the charge valve 130 is a control valve sensitive to seawater pressure through seawater tap 136, which may also contain a seawater filter to isolate the valve seat 142 from the seawater. In one embodiment, outside pressure port 136 is a seawater tap and contains a threaded portion 137 for installing a seawater filter. The setting of the spring force of the valve spring 138, which acts between the stem of the valve seat 142 and the stem of the valve piston 144, is additive to the force of the seawater pressure on the valve piston biasing the valve to a closed position. Charge valve 130 also contains a valve seat 142 with an adjustment mechanism 143 to counter balance seawater pressure. Preferably, the valve piston 144 seats against the valve body 140 to form a metal-to-metal seal 146. However, elastomeric or other alternative sealing assemblies known in the art may be used. In addition, in one embodiment elastomeric seals 148 are included as back-up seals to metal-to-metal seal 146.

In the embodiment using nitrogen, the gas is supplied by a nitrogen gas generator system and is initially fed through the compressed gas line 132 to the charge valve 130 and through the inlet of the valve. The charge valve inlet is normally closed by the hydrostatic pressure of sea water acting on the valve piston 144 plus the pre-set closing force of the valve spring 138. When charging pressure acting over the area of the valve seat 142 generates a force exceeding spring force plus the force of seawater acting on the area of the valve piston 144, the valve 130 opens to charge the manifold 120 and the bladders 110 attached thereto. Note, that the valve piston 144 will backseat when the valve 130 is in the open position, assuring the addition of a metal seal 146 to moving seals 148, which may be elastomeric, in the open position.

Seawater pressure is usually accepted as 0.500 psi per foot of depth, therefore, a charging control valve placed at 4,000 feet in a riser will open at approximately 2,200 psi (2,000 psi seawater pressure plus 200 psi due to spring pressure). This of course can be altered by changing the setting of the spring force, but it is the purpose of the spring to assure valve closure at levels above the deepest point of setting for an adjustable module. As an example, positioning the same adjustable module at 1,000 feet in the same riser discussed in the first part of this paragraph, would require a spring setting equal to 1,700 psi to achieve valve closure when using the dedicated nitrogen line to operate the valve at 4,000 feet. However, in one embodiment the spring force will be between approximately 25 and 50 psi.

4. Emergency Dump Valve

Figure 12:
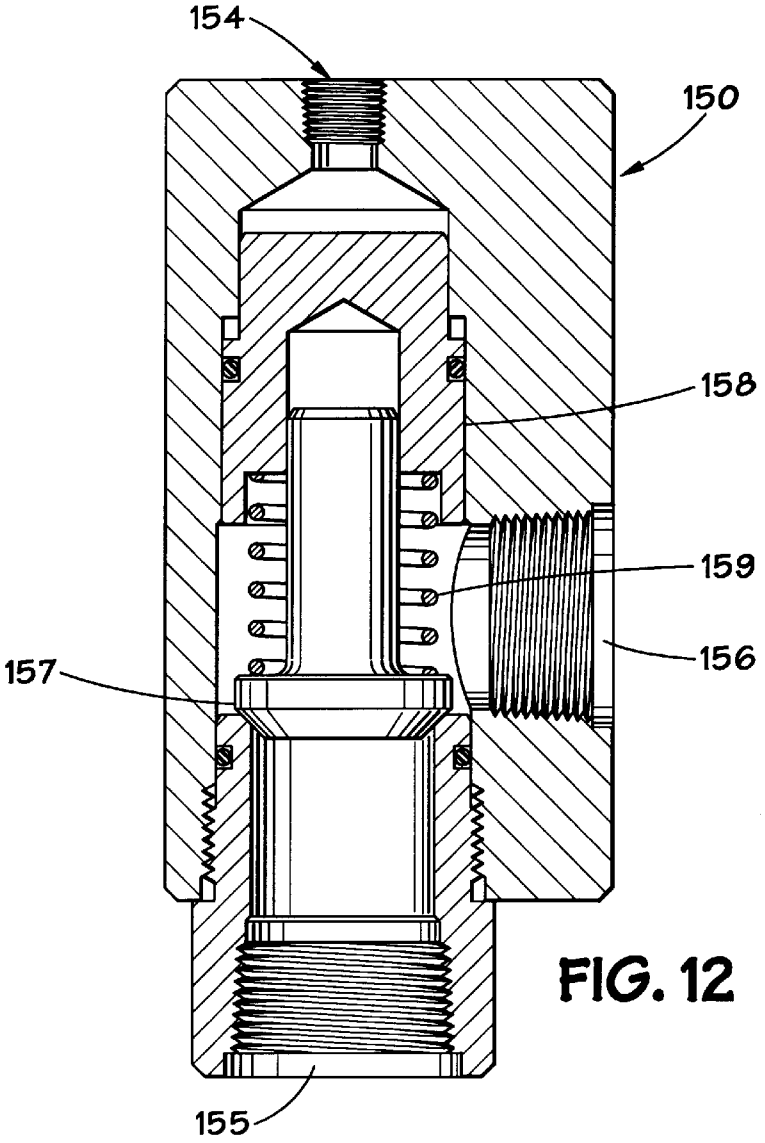
FIG. 12 is a sectional illustration of an embodiment of a discharging valve of the current invention.

When the riser is recovered to the drillship the buoyancy in the adjustable phase buoyancy modules 100 must be reduced. The discharge or emergency dumping valve 150 of FIG. 12 is designed to discharge nitrogen or other compressed gas from the manifold 120 and the pressure bladders 110 connected thereto. The emergency dump valve 150 is intended to bleed gas from the bladders 110 during normal riser recovery, and to discharge the nitrogen from the system in the event of a break in the riser. This control valve 150 is maintained in closed position through hydraulic pressure from hydraulic line 160 applied through hydraulic connection 154. The emergency dump valve 150 will fail open upon removal of hydraulic line pressure by intent or accident, discharging the compressed gas from manifold 120 into discharge line 152 through discharge outlet 156. When coupled at connector 155 to the manifold 120, dump valve 150 is subject to the same pressure as is in the bladders 110, which acts over the large area valve seat to oppose the force of hydraulic pressure acting on piston 158 plus force from spring 159 or other biasing member, to hold the valve 150 closed.

Hydraulic fluid is supplied from a surface pump through the hydraulic line 160 to hold the valve closed (normally a fail-safe open), by acting on the area of the piston 158 to supplement the closing force of the spring 159. Two different and separate functions are required of emergency dump valve 150: (1) reduce manifold and bladder pressure proportionately with seawater pressure by reducing hydraulic line pressure as the riser is recovered, and (2) in an emergency, should a riser break severing hydraulic line 160, allow the gas pressure in the manifold 120 to open the valve seat 157 and discharge the gas from the dependent bladders 110 and the manifold 120. Thus, opening or accidental rupture of the hydraulic line 160 will result in immediate dumping of the gas from the manifold 120 and the bladders 110, as seawater pressure deflates the bladders.

The riser may therefore be recovered to the surface under controlled buoyancy conditions, either discharging compressed gas as the riser is recovered, or explosively discharging the gas from the manifold 120 and the bladders 110 to assure that the riser is not driven upwardly into the drilling vessel slip joint causing damage.

It will be appreciated by those of ordinary skill in the art having the benefit of this disclosure that numerous variations from the foregoing illustrations will be possible without departing from the inventive concept described herein. In addition, the above description and the following claim are directed in some instances to single elements of the invention such as single flotation modules, valves, etc. This approach has been taken in the interest of simplification and clarity, and with recognition that the invention is not limited to such single elements. More complex embodiments of the invention involving multiple such elements are effectively multiple versions of the single elements and are intended to be embraced by such description and claims.

What is claimed is:

1. An underwater riser system comprising:

a) a riser;

b) a plurality of passive flotation modules disposed along a longitudinal axis of the riser and coupled to the riser;

c) a plurality of active flotation modules disposed along the longitudinal axis of the riser and coupled to the riser;

d) a gas flow conduit;

e) a charge valve connected to the gas flow conduit having a first port connected to the gas flow conduit to selectively allow flow therethrough;

f) a manifold coupled circumferentially to the riser and having an inlet sealingly connected to a second port of the charge valve, the manifold also having at least one nipple engaging at least one active flotation module to allow flow thereto;

g) a discharge valve conjoined with an outlet of the manifold.

2. The system of claim 1 wherein the plurality of passive flotation modules and the plurality of active flotation modules comprise interlocking sections.

3. The system of claim 2 further comprising substantially impermeable tubes disposed within the interlocking section of the plurality of passive flotation devices.

4. The system of claim 3 wherein the tubes are formed of a plastic and are sealed after being filled with a compressed gas or evacuated.

5. The system of claim 1 wherein the gas flow conduit provides a compressed gas.

6. The system of claim 5 further comprising a valve biasing member wherein the valve biasing member urges the charge valve into a closed position to restrict the flow of the compressed gas between the first and second ports.

7. The system of claim 6 wherein the charge valve further comprises a third port coextensive with the first port, the third port being open to a seawater pressure such that the seawater pressure further urges the charge valve into a closed position.

8. A riser system with flotation apparatus comprising:

a) a plurality of riser sections each having an outer diameter;

b) at least one passive flotation module coupled to the outer diameter of a riser section, the passive flotation module comprising an outer hardenable resin skin surrounding an inner syntactic foam core, and at least one tube contained within the inner buoyant core;

c) at least one active flotation module coupled to the outer diameter of a riser section, the active flotation module comprising a protective housing covering a pressure containing bladder;

d) a manifold containing at least one flow nipple, the flow nipple coupled to the pressure containing bladder forming a flow passage between the manifold and the pressure containing bladder;

e) a charge valve with a first port coupled to an inlet of the manifold, and a discharge valve with a first port coupled to an outlet of the manifold, the charge and discharge valves each comprising a valve body, a valve piston having a valve seat movably contained within the valve body, the valve seat operable to control flow through the first port of the charge and discharge valve;

f) a gas line coupled to a second port of the charge valve, the second port in communication with the first port in the charge valve when the charge valve is in an open position, to allow flow into the manifold;

g) a discharge outlet port in the discharge valve, the discharge outlet port in communication with the first port in the discharge valve when the discharge valve is in an open position, to allow flow out of the manifold, and;

h) a hydraulic control line coupled to a control port in the discharge valve and selectively providing hydraulic pressure suitable to maintain the discharge valve in a closed position.

9. The system of claim 8 wherein the tube is substantially impermeable such that the tube may be evacuated or filled with a gas.

10. Apparatus for controlling the pressure in a gas-adjustable buoyancy system, the apparatus comprising:

a) a gas line;

b) a first control valve having a valve body, an inlet port through the valve body coupled to the gas line, and an outlet port through the first control valve body;

c) a valve piston having a valve seat at a first end and a valve adjustment mechanism at a second end, the valve piston slidably contained within the valve body such that the valve seat engages and seals the inlet port to restrict gas flow or disengages from the inlet port to allow gas flow from the inlet port to the outlet port;

d) a first valve biasing member coupled to the valve seat;

e) a manifold connected to the outlet port of the first control valve and having a plurality of junctions for connecting to the gas-adjustable buoyancy system, and;

f) a second control valve coupled to the manifold, the second control valve having a valve body, a first port through the valve body coupled to the manifold, a second port through the valve body, and a third port through the valve body;

g) the valve body of the second control valve housing a valve piston having a valve seat at a first end, the valve piston slidably contained within the valve body such that the valve seat engages and seals the first port to restrict gas flow or disengages from the first port to allow gas flow from the first port to the second port, the valve piston also having seals to prevent the transfer of gas or liquid between the third port and either the first or second ports;

h) a control line coupled to the third port of the second control valve, the control line operable to compel the valve piston to a position where the valve seat engages the first port;

i) a valve biasing member coupled to the valve seat of the second control valve, the valve biasing member opposing the operation of the control line.

11. The apparatus of claim 10 further comprising a control port through the valve body of the first control valve.

12. The apparatus of claim 11 wherein the control port is open to outside pressure, and wherein the outside pressure cooperates with the biasing member of the first control valve.

13. Apparatus for providing buoyancy to a subsea riser system, the apparatus comprising:

a) a first buoyancy module segment attached to the riser system and having an interior buoyant component and an exterior component, the exterior component containing the interior component;

b) a second buoyancy module segment attached to the riser system and having a pressure bladder and an outer housing, the outer housing containing the pressure bladder;

d) a manifold system comprising a gas line, a charge valve having a first port coupled to the gas line and a second port coupled to a manifold, the charge valve operable to control gas flow between the first and second ports, a gas conduit connected to the second port of the charge valve, a connector connecting the gas conduit to the pressure bladder, and a discharge valve having a first port coupled to the gas conduit, a second port, and a third port connected to a control system, the discharge valve operable to control gas flow between the first and second ports.

14. The apparatus of claim 13 further comprising choke and kill lines fixedly attached to the riser system, and wherein the first and second buoyancy module segments are adapted to attach to the riser system with the choke and kill lines in place.

15. The apparatus of claim 14 wherein the first and second buoyancy module segments comprise arcuate sections.

16. The apparatus of claim 15 wherein the first buoyancy module segments comprise minor arcuate sections adapted for installation over the choke and kill lines, and major arcuate segments.

17. The apparatus of claim 13 wherein the interior buoyant component of the first buoyancy module segment is syntactic foam.

18. The apparatus of claim 13 wherein the exterior component is comprised of a hardenable resin.

19. The apparatus of claim 18 wherein the exterior component further comprises fiberglass.

20. The apparatus of claim 13 further comprising tubes installed within the first buoyant module segment.

21. The apparatus of claim 20 wherein the tubes are evacuated.

22. The apparatus of claim 21 wherein the tubes contain a compressed gas.

23. The apparatus of claim 22 wherein the tubes have a connector at a first end connected and sealed to a valve.

24. A valve for controlling the gas pressure in a subsea riser buoyancy system at a given seawater depth, the valve comprising:

a) a valve body having an inner bore defining a first port and a second port extending axially through the valve body, and a third port extending laterally through the valve body, the third port intersecting with the first and second ports;

b) a gas inlet connector defining an axial passage, coupled and sealed to the first port, the gas inlet connector having a first end and having a second end for connection to a gas supply line;

c) a valve seat for engaging and sealing to the first end of the gas inlet connector;

d) a valve piston slidably disposed between the first and second ports;

e) at least one seal disposed between the valve piston and the inner bore of the valve body;

f) a valve biasing member disposed between the valve piston and the valve seat to urge the valve seat toward contact with the first end of the gas inlet connector, and;

g) a seawater filter set in the second port whereby seawater pressure at the given depth urges the valve seat toward contact with the first end of the gas inlet connector, in conjunction with the action of the valve biasing member, without contact between the valve piston and the seawater.

25. The valve of claim 24 further comprising a valve seat adjustment to compensate for the effect of seawater pressure at a given depth.

26. The valve of claim 25 wherein the at least one seal is an elastomeric seal.

27. The valve of claim 24 wherein the valve seat engages the first end of the gas inlet connector to form a metal-to-metal seal.

* * * * *